US008247970B2

(12) United States Patent
Setoguchi et al.

(10) Patent No.: US 8,247,970 B2
(45) Date of Patent: Aug. 21, 2012

(54) PLASMA DISPLAY PANEL AND METHOD OF MANUFACTURING THE SAME

(75) Inventors: Noriaki Setoguchi, Miyazaki (JP); Masahiro Sawa, Miyazaki (JP); Yuji Kobayashi, Kunitomi (JP)

(73) Assignee: Hitachi, Ltd., Tokyo (JP)

( * ) Notice: Subject to any disclaimer, the term of this patent is extended or adjusted under 35 U.S.C. 154(b) by 174 days.

(21) Appl. No.: 12/183,684

(22) Filed: Jul. 31, 2008

(65) Prior Publication Data

US 2009/0146567 A1 Jun. 11, 2009

(30) Foreign Application Priority Data

Dec. 6, 2007 (JP) ..... 2007-315583

(51) Int. Cl.
*H01J 17/49* (2006.01)
*H01J 9/24* (2006.01)

(52) U.S. Cl. ..... 313/583; 313/587; 445/24

(58) Field of Classification Search ..... 313/582–587; 345/30, 37, 60; 445/24–25
See application file for complete search history.

(56) References Cited

U.S. PATENT DOCUMENTS

| | | | | |
|---|---|---|---|---|
| 6,417,620 | B1 | 7/2002 | Yasue | |
| 7,714,508 | B2 | 5/2010 | Chung | |
| 2002/0063510 | A1 | 5/2002 | Yura et al. | |
| 2002/0140349 | A1* | 10/2002 | Kato et al. | 313/582 |
| 2006/0113890 | A1* | 6/2006 | Yoo et al. | 313/496 |
| 2006/0145622 | A1* | 7/2006 | Adachi et al. | 313/631 |
| 2006/0290862 | A1* | 12/2006 | Yanagawa et al. | 349/139 |

FOREIGN PATENT DOCUMENTS

| | | |
|---|---|---|
| EP | 1 351 270 A2 | 10/2003 |
| EP | 1 589 556 A1 | 10/2005 |
| JP | 2000-082395 | 3/2000 |
| JP | 2000-348627 | 12/2000 |
| JP | 2001-216902 | 8/2001 |
| JP | 2002-075229 | 3/2002 |
| JP | 2003-068215 | 3/2003 |
| JP | 2005-19008 | 1/2005 |
| JP | 2006-318901 | 11/2006 |

OTHER PUBLICATIONS

European Search Report issued in European Patent Application No. EP 08 25 2997, dated Aug. 6, 2009.
Chinese Office Action, issued in Chinese Patent Application No. 2008101098158, dated Nov. 27, 2009.
Japanese Office Action, issued in Japanese Patent Application No. 2007-315583, dated Sep. 6, 2011.

* cited by examiner

*Primary Examiner* — Anh Mai
*Assistant Examiner* — Elmito Breval
(74) *Attorney, Agent, or Firm* — McDermott Will & Emery LLP

(57) ABSTRACT

A PDP (Plasma Display Panel) comprising a front substrate structure (first substrate structure) in which two pairs of an X electrode and a Y electrode and a non-emission area therebetween are formed, and a plurality of light-shielding films formed with spacing from the X electrode and the Y electrode in the non-emission area. The light-shielding film contains a metal material common with a metal material forming the X electrode and the Y electrode. And, the light-shielding film is formed in an island-shape having spacing from a neighboring barrier rib formed to a rear substrate structure (second substrate structure). According to the above structure, the area of the light-shielding film which may cause a capacitance-coupled portion with the X electrode, the Y electrode, or an address electrode can be made small, thereby suppressing capacitance coupling even when a conductive material is used to the light-shielding film.

3 Claims, 7 Drawing Sheets

PLASMA DISPLAY PANEL AND METHOD OF MANUFACTURING THE SAME

CROSS-REFERENCE TO RELATED APPLICATION

The present application claims priority from Japanese Patent Application No. JP 2007-315583 filed on Dec. 6, 2007, the content of which is hereby incorporated by reference into this application.

BACKGROUND OF THE INVENTION

The present invention relates to a technique for a plasma display panel. More particularly, the present invention relates to a technique effectively applied to a plasma display panel having a light-shielding film of dark colors formed in a non-emission area between a pair of display electrodes.

In recent years, an alternate-current plasma display device which performs surface discharge has been put into practical use as a flat-type plasma display device, and it has become widely used for a plasma display device for personal computer and work station etc., a flat-type wall-hung television, or a device for displaying advertisement and information etc. Accordingly, a technique capable of obtaining high contrast has been strongly desired to a plasma display panel (PDP: Plasma Display Panel) to be embedded in such a plasma display device so as to improve image quality.

A PDP comprises a front substrate and a rear substrate, and a discharge gap in which a discharge gas such as rare gas is filled is formed between the front substrate and the rear substrate. A plurality of display electrode pairs are arranged to the front substrate, and a dielectric layer covering the display electrode pair is formed. And, a non-emission area which does not contribute to display emission of the PDP is provided between the display electrode pairs next to each other. Further, a barrier rib which sections the discharge gap and an address electrode arranged to cross the display electrode pair are formed to the rear substrate. Moreover, phosphors which emit visible light of red (R), green (G), and blue (B) that are primary colors are formed in respective emission areas in respective discharge gaps sectioned by the barrier ribs.

In the PDP, a voltage is applied across the display electrodes to generate surface discharge in a discharge gap, so that phosphors are excited by vacuum ultraviolet light generated by the discharge, thereby displaying desired color image. And, a cell to be selected its on/off is arranged at every intersection of the display electrode pair and the address electrode.

A system to select a cell is made such that a voltage is applied across the address electrode and one of the display electrode pair so that an opposed discharge (address discharge) is generated in the cell at which the electrodes intersect, thereby selecting a cell to perform the surface discharge.

Outside light is irradiated on the non-emission area from the front substrate side, and when it is reflected, the contrast (bright-room contrast) of the PDP is lowered. As a method for improving the bright-room contrast, for example, Japanese Patent Application Laid-Open Publication No. 2000-82395 (Patent Document 1) discloses a structure in which a stripe-like light-shielding film called black-stripe layer is formed in the non-emission area at the front substrate side.

And, for example, Japanese Patent Application Laid-Open Publication No. 2002-75229 (Patent Document 2) discloses a method for making a process of forming a light-shielding film efficient, that is, a method of forming the light-shielding film by using a same material with a bus electrode configuring a display electrode pair.

SUMMARY OF THE INVENTION

However, the inventors of the present invention have found out that the following problems are posed in the case of forming a light-shielding film formed by a same material with a bus electrode in the non-emission area.

Particularly, when using a same conductive material with the bus electrode as the light-shielding film, a parasitic capacitance occurs between the bus electrode and the light-shielding film or between the light-shielding film and the address electrode.

If the parasitic capacitance occurs, reactive power which does not contribute to the emission is increased when flowing a current to the bus electrode or the address electrode.

In addition, if a large voltage is applied across the bus electrode and the address electrode upon an address discharge which is a discharge for selecting On/Off of cells, an error discharge may be generated due to the capacitance coupling. More particularly, the applied voltage in the address discharge has to be smaller to prevent an error discharge, and accordingly, a margin of allowed voltage value (operating margin) for generating proper discharge is reduced.

The present invention has been made in view of the above problems, and an object thereof is to provide a technique capable of suppressing an increase of reactive power and the capacitance coupling which causes reduction of operating margin.

The above and other objects and novel characteristics of the present invention will be apparent from the description of this specification and the accompanying drawings.

The typical ones of the inventions disclosed in this application will be briefly described as follows.

More particularly, a plasma display panel according to one embodiment of the present invention comprises a first substrate structure and a second substrate structure which are opposing each other interposing a discharge gap, where the first substrate structure includes: a first substrate; a plurality of display electrode pairs that are formed along a first direction at a first surface side of the first substrate opposing the second substrate structure; a dielectric layer covering the plurality of display electrode pairs; a non-emission area formed along the first direction between the two display electrode pairs next to each other; and a plurality of light-shielding films formed in the non-emission area having spacing from the display electrode pair, the second substrate structure includes: a second substrate; an address electrode formed along a second direction intersecting the first direction at a second surface side of the second substrate opposing the first substrate structure; and a barrier rib formed at the second surface side of the second substrate and along the second direction so as to section the discharge gap, and the plurality of light-shielding films contain a metal material which is common with a metal material forming the display electrode pair and are formed in island-shape having spacing from the neighboring barrier rib.

The effects obtained by typical aspects of the present invention will be briefly described below.

More specifically, according to one embodiment of the present invention, it is possible to reduce the area of the light-shielding film which may form a parasitic coupling portion with the display electrode pair or the address electrode, thereby suppressing the capacitance coupling with the display electrode pair or the address electrode even when a conductive material is used for the light-shielding film.

BRIEF DESCRIPTIONS OF THE DRAWINGS

These and other features, objects and advantages of the present invention will become more apparent from the following description when taken in conjunction with the accompanying drawing wherein.

Figure 10:
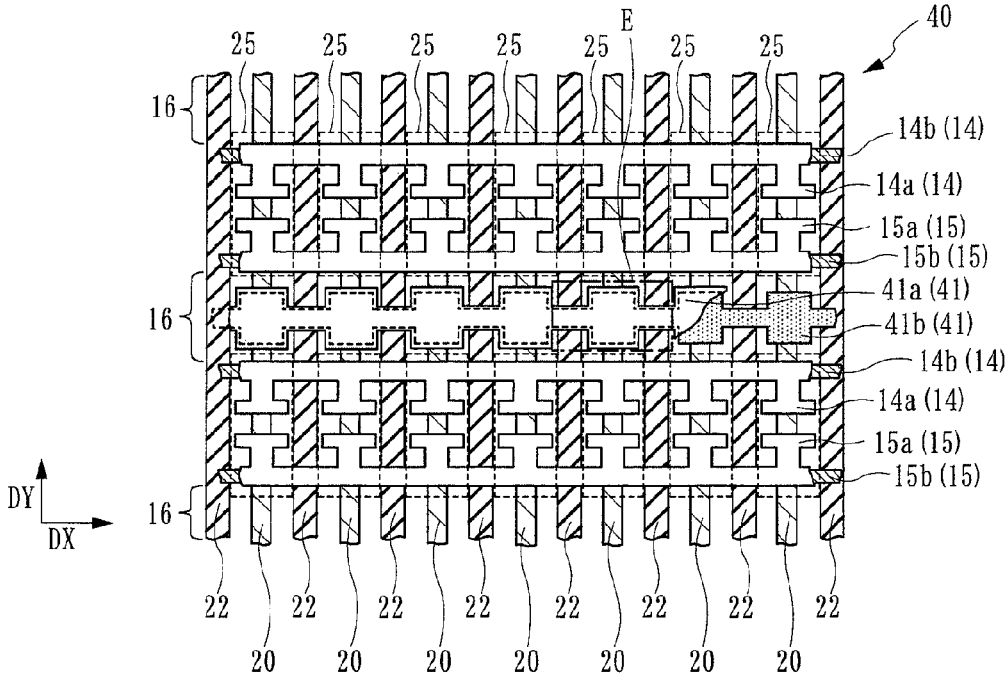
Figure 11:
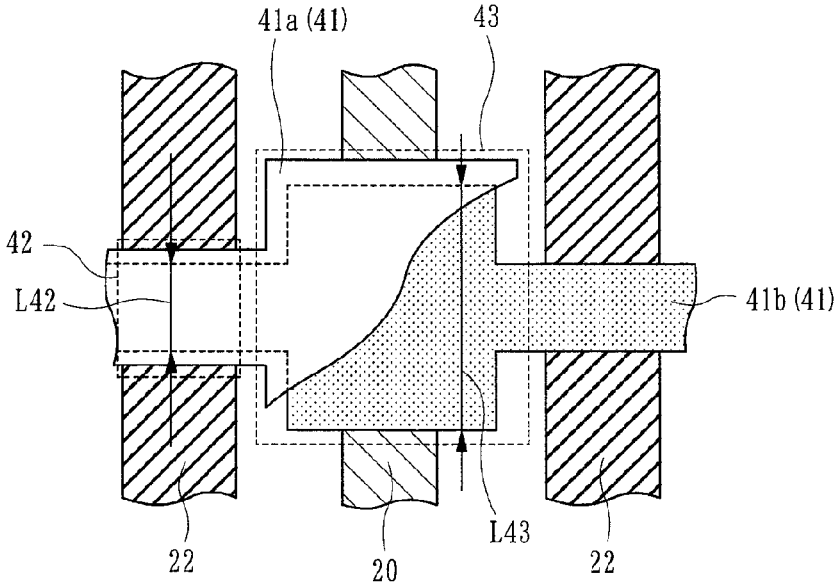
Figure 12:
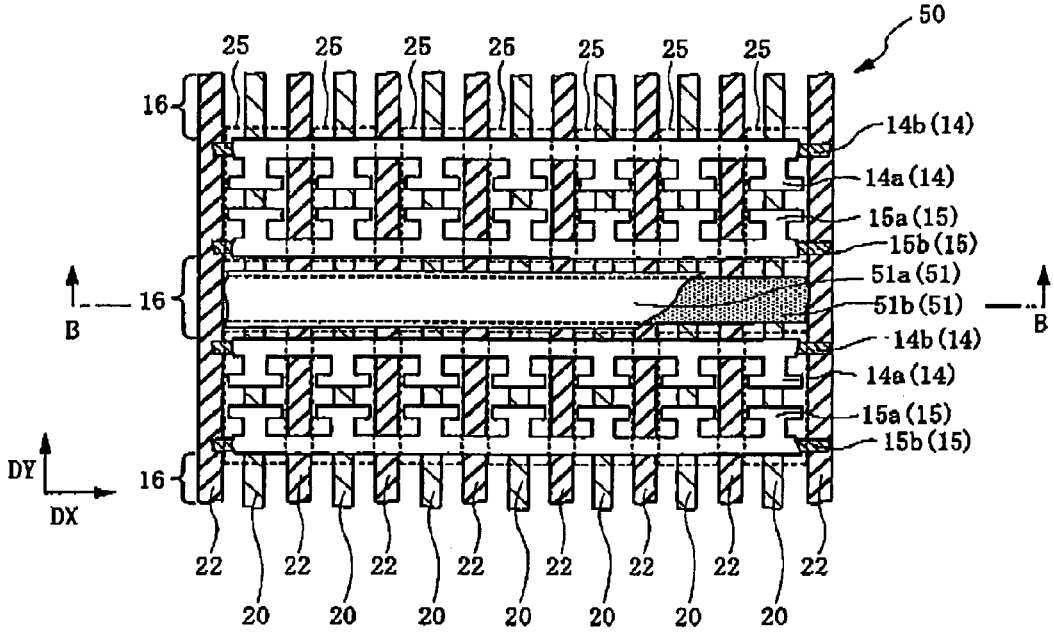
Figure 13:
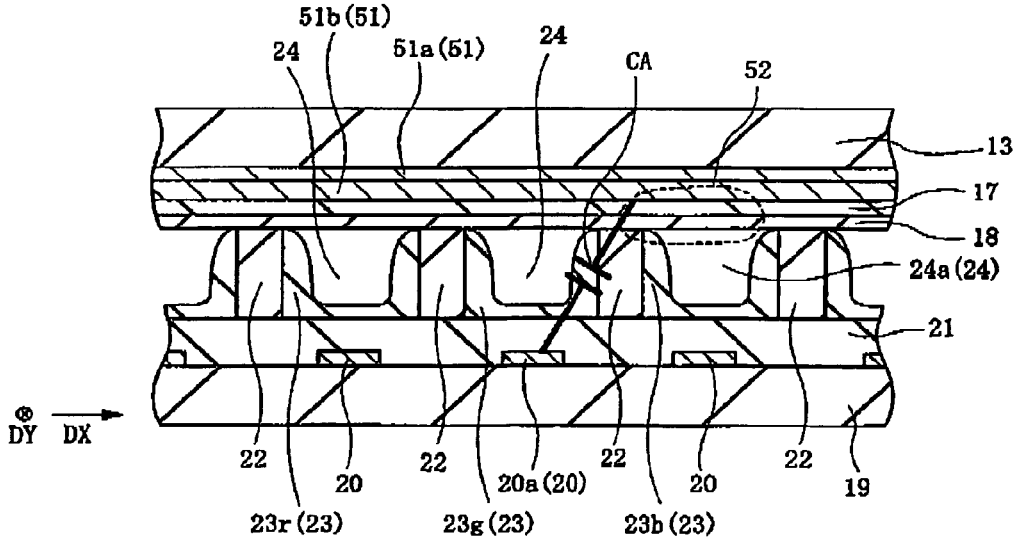

FIG. 10 an enlarged planar view of main parts showing a planar positional relationship of an electrode group, a barrier rib, and a light-shielding film of a PDP according to a fourth embodiment of the present invention viewed from a display surface side;

FIG. 11 is an enlarged planar view showing the E area shown in FIG. 10 in further enlarged manner;

FIG. 12 is an enlarged planar view of main parts showing a planar positional relationship of an electrode group, a barrier rib, and a light-shielding film of a PDP according to a comparative example of the present invention viewed from a display surface side; and FIG. 13 is an enlarged cross-sectional view of main parts showing part of a cross section taken along the line B-B shown in FIG. 12 in an enlarged manner.

DESCRIPTIONS OF THE EMBODIMENTS

In the embodiments described below, the invention will be described in a plurality of sections or embodiments when required as a matter of convenience. However, these sections or embodiments are not irrelevant to each other unless otherwise stated, and the one relates to the entire or a part of the other as a modification example, details, or a supplementary explanation thereof.

Also, components having the same function are denoted by the same reference symbols throughout the drawings for describing the embodiments, and the repetitive description thereof will be omitted. Further, hatching is used even in a plan view so as to facilitate understanding of respective members throughout the drawings for describing the embodiments. Hereinafter, embodiments of the present invention will be described in detail with reference to the accompanying drawings.

First Embodiment

<Basic Configuration of Plasma Display Device>

First, a whole configuration and a method of grayscale drive of a plasma display device (hereinafter, called as a PDP device) embedding a PDP according to a first embodiment will be described with reference to FIG. 1 and FIG. 2.

Figure 1:
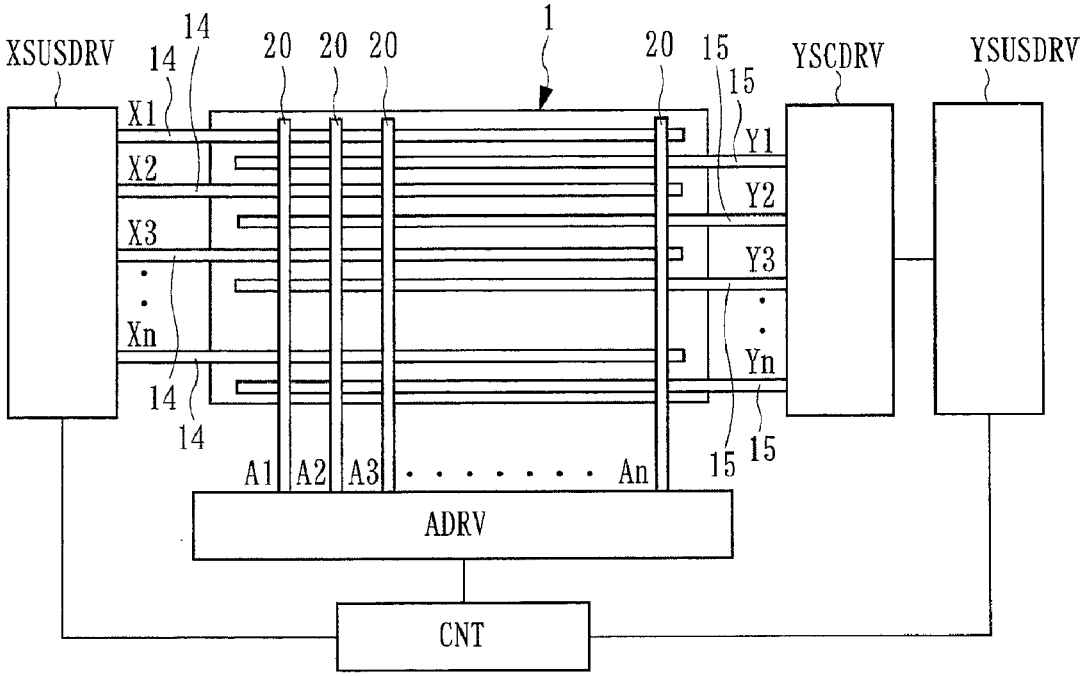
FIG. 1 is a block diagram schematically showing a whole configuration of one example of a PDP device embedding a PDP according to a first embodiment of the present invention.

FIG. 1 is a block diagram schematically showing a whole configuration of one example of a PDP device embedding a PDP according to the first embodiment. And, FIG. 2 is an explanatory diagram showing one example of a grayscale drive sequence in the PDP device shown in FIG. 1.

While a PDP 1 shown in FIG. 1 will be described in detail later, the PDP 1 comprises an X electrode 14, a Y electrode 15, an address electrode 20, and a barrier rib (rib) not shown etc. And, to apply a voltage to respective electrodes (14, 15, 20), an address driver ADRV, a Y scan driver YSCDRV, a Y sustain driver YSUSDRV, an X sustain driver XSUSDRV are electrically connected. Moreover, a control circuit CNT for controlling respective drivers is provided.

For example, field data which is multivalued image data indicating luminance levels of three colors red (R), green (G), and blue (B), and various kinds of synchronous signals (clock signal CLK, horizontal synchronous signal Hsync, vertical synchronous signal Vsync) are inputted from external devices such as a TV tuner and computer. And, the control circuit CNT outputs control signals proper to respective drivers from the field data and the various synchronous signals so that a predetermined image display is performed.

In the PDP 1, the X electrodes (X1, X2, X3, . . . , Xn) 14 AND the Y electrodes (Y1, Y2, Y3, . . . , Yn) 15 for performing sustain discharge (display discharge) are alternately arranged to configure display lines, and cells in matrix are formed on respective intersections of the display electrode pairs formed by the X electrodes 14 and the Y electrodes 15 and the address electrodes (A1, A2, A3, . . . , An) 20 orthogonally crossing the display electrode pairs.

The Y scan driver YSCDRV controls the Y electrode to sequentially select the Y electrodes (display lines) 15 in an address sequence TA (cf. FIG. 2), so that an address discharge for selecting on/off of cells with respect to each subfield SF1 to SFn (see FIG. 2) is generated between the address electrode 20 electrically connected to the address driver ADRV and each Y electrode 15.

Figure 2:
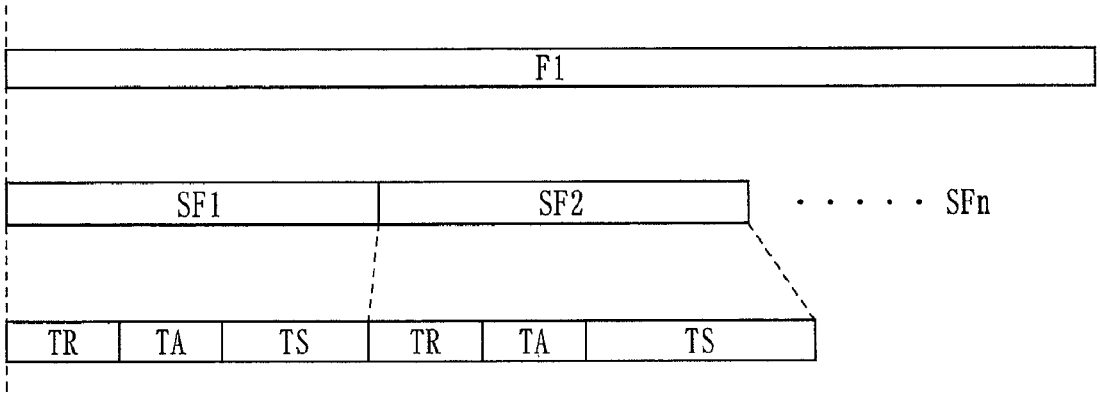
FIG. 2 is an explanatory diagram showing one example of a grayscale drive sequence of the PDP device in FIG. 1.

And, the Y sustain driver YSUSDRV and the X sustain driver XSUSDRV generate sustain discharges corresponding to weighting of each subfield with respect to the cell selected by the address discharge in a display sequence TS (cf. FIG. 2).

Further, as shown in FIG. 2, the grayscale drive sequence of the PDP device is made such that one field (frame) F1 is configured by a plurality of subfields (subframes) SF1 to SFn respectively having a predetermined luminance weighting, and desired grayscale display is performed by combinations of each subfield SF1 to SFn.

To describe a configuration example of the plurality of subfields, for example, 256-grayscale display is preformed by eight subfields SF1 to SF8 having luminance weightings of powers of 2 (ratio of the number of sustain discharges is 1:2:4:8:16:32:64:128). Note that, it is needless to say that combinations of the number of subfields and the weighting of each subfield can be variously made.

And, each subfield SF1 to SFn is configured by: a initialization sequence (reset period) TR for uniformizing wall charges of all cells in the display area; an address sequence (address period) TA for selecting ON-cell; and a display sequence (sustain discharge period) TS for making discharges (turn-on) of the selected cell for the number of times corresponding to the luminance (weighting of each subfield). A cell is turned on according to luminance per display of each subfield, and for example, one field display is performed by displaying eight subfields (SF1 to SF8), thereby performing a display of one field.

<Basic Structure of PDP>

Figure 3:
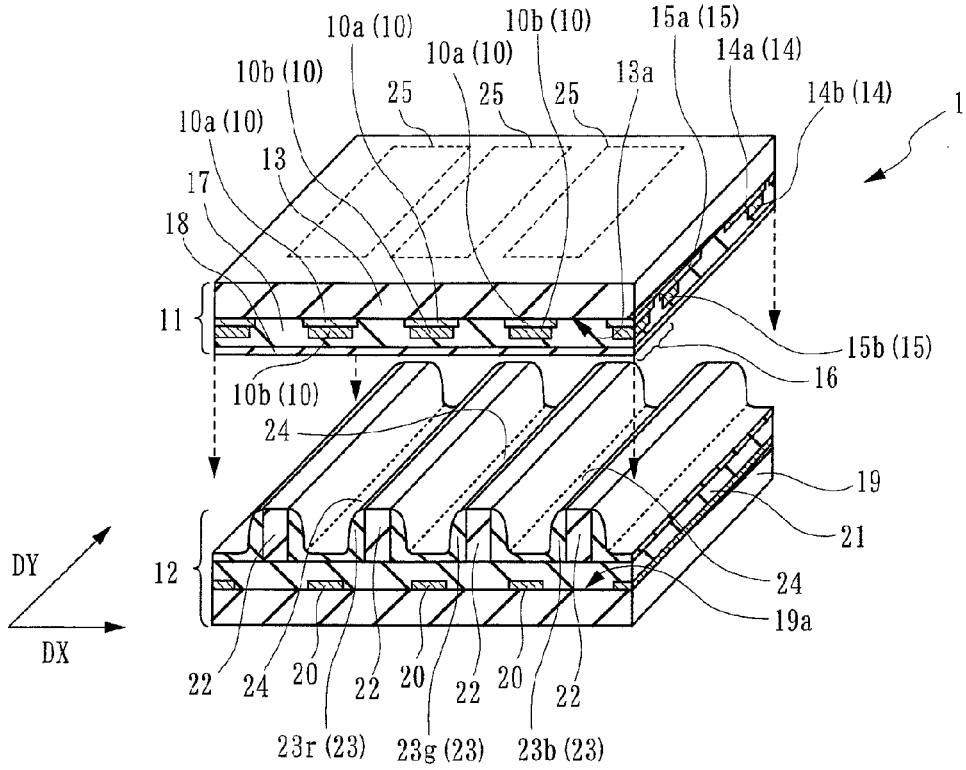
FIG. 3 is an enlarged perspective view of main parts showing main parts of the PDP according to the first embodiment of the present invention in an enlarged manner.

Next, an example of a configuration of the PDP according to the first embodiment will be described exemplifying an AC surface discharge type PDP with reference to FIG. 3 and FIG. 4. FIG. 3 is an enlarged assembly perspective view of main parts showing main parts of the PDP of the first embodiment in an enlarged manner, and FIG. 4 is an enlarged planar view of main parts showing a planar positional relationship of the electrode group, the barrier rib, and a light-shielding film viewed from a display surface side.

Figure 4:
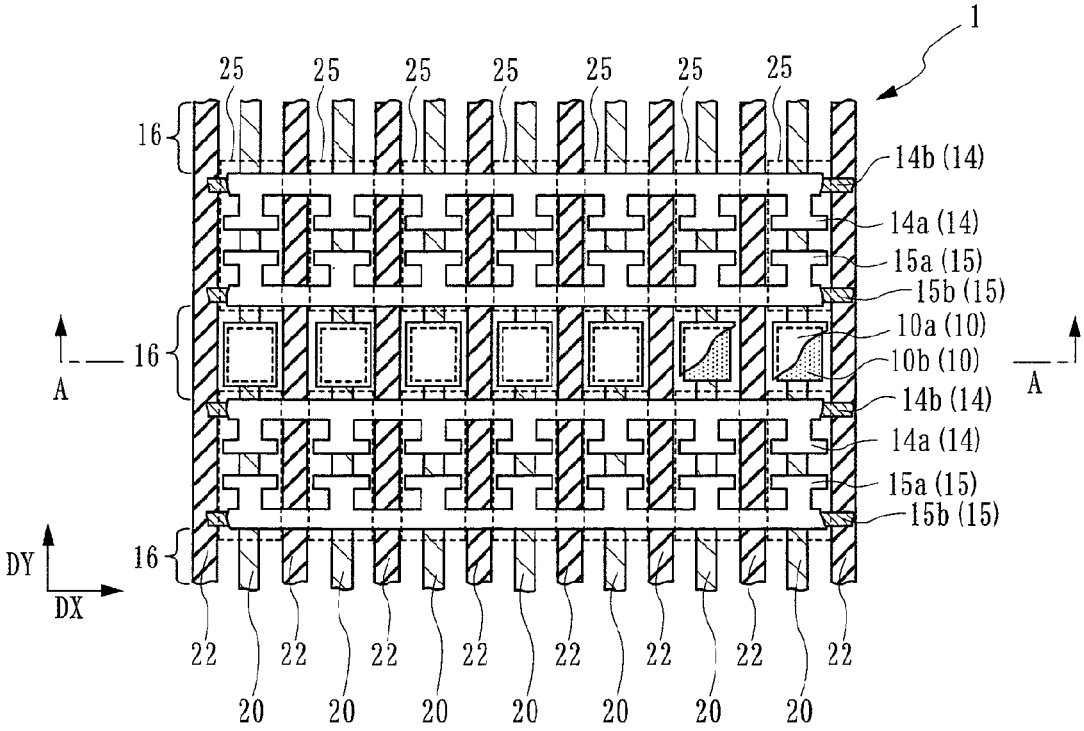
FIG. 4 is an enlarged planar view of main parts showing a planar positional relationship of an electrode group, a barrier rib, and a light-shielding film shown in FIG. 3 viewed from a display surface side.

Note that, in FIG. 4, to show the positional relationship of the electrode group, the barrier rib and the light-shielding film easily understandable, other members are omitted in the drawing.

In FIG. 3, the PDP 1 comprises a front substrate structure (first substrate structure) 11 and a rear substrate structure (second substrate structure) 12. The front substrate structure 11 and the rear substrate structure are overlapped opposing each other and have a discharge gap therebetween.

The front substrate structure has a display surface of the PDP 1, and a front substrate (substrate, first substrate) 13 mainly formed of glass is formed at the display surface side. The plurality of X electrodes (second electrode, sustain electrode) 14 and the plurality of Y electrodes (first electrode, scan electrode) 15 which are the display electrodes of the PDP 1 to a surface (first surface) 13*a* opposite to the display surface of the front substrate 13 (cf. FIG. 4).

The X electrode 14 and the Y electrode 15 configure a pair of display electrodes for performing sustain discharge (also called display discharge), and for example, they are arranged alternately so as to extend along a row direction (first direction, lateral direction) DX. The pair of X electrode 14 and the Y electrode 15 configures a row of display in the PDP 1.

The X electrode and the Y electrode are generally configured by, for example, an X transparent electrode (transparent electrode portion) 14*a* and a Y transparent electrode (transparent electrode portion) 15*a* formed of a transparent electrode material such as ITO (Indium Tin Oxide) and an X bus electrode (light-shielding electrode portion) 14*b* and a Y bus electrode (light-shielding electrode portion) 15*b* electrically connected to the respective transparent electrodes.

The X transparent electrode 14*a* and the Y transparent electrode 15*a* have transmittance with respect to visible light emitted from phosphor portions 23 that will be described later different from that of the X bus electrode 14*b* and the Y bus electrode 15*b*.

As shown in FIG. 4, the X transparent electrode 14*a* and Y transparent electrode 15*a* are formed to protrude toward opposite directions to each other from the X bus electrode 14*b* and the Y bus electrode 15*b* so that a minimum distance between the pair of electrodes (called discharge gap) become locally close corresponding to a position of a cell 25 for stabilizing sustain discharge and improving discharge efficiency. Since positions where the X transparent 14*a* and the Y transparent electrode 15*a* are formed correspond to the cell 25 of the PDP 1, and the X transparent electrode 14*a* and the Y transparent electrode 15*a* are formed of a transparent electrode material so as to transmit visible light emitted from the phosphor portions described later.

Note that, while a T-type shape is shown as an example of a shape of the protruding portions which the X transparent electrode 14*a* and the Y transparent electrode 15*a* respectively have in FIG. 4, the shape is not limited to this and various modifications are also applicable.

For example, an edge of the protruding portion may be simply an I-type structure instead of the T-type. And, the X transparent electrode 14*a* and the Y transparent electrode 15*a* may not have the protruding portions formed thereto and may have an electrode structure of a stripe-like shape same as the X bus electrode 14*b* and the Y bus electrode 15*b*.

On the other hand, the X bus electrode 14*b* and the Y bus electrode 15*b* are formed for reducing electric resistances of the X electrode 14 and the Y electrode 15, and formed of a metal material such as Cu and Ag having a lower resistance than the transparent electrode. Further, the metal material is not limited to single component, and for example, when using Cu, a multilayered structure where Cr/Cu/Cr is sequentially formed can be used for preventing oxidation of Cu and improving adhesiveness of Cu to ITO.

Since the X bus electrode 14*b* and the Y bus electrode 15*b* are formed of a metal material in this manner, they have higher light-shielding property to visible light as compared with the X transparent electrode 14*a* and the Y transparent electrode 15*a*. In other words, they have low transmittance of visible light. Also, since surfaces of the X bus electrode 14*b* and the Y bus electrode 15*b* prevent or suppress reflection of outside light, they are formed to make a tone of black or dark color.

Therefore, the structure is made such that, when outside light is irradiated in a thickness direction of the front substrate structure 11, the light is absorbed in the part where the X bus electrode 14*b* and the Y bus electrode 15*b* are provided, so that reflectivity of outside light is reduced.

And, as shown in FIG. 4, between two display electrode pairs (pairs of the X electrode 14 and the Y electrode 15) next to each other, a non-emission area 16 which does not contribute to display emission of the PDP 1 is formed. The non-emission area 16 is formed along the row direction DX. This non-emission area 16 has a plurality of light-shielding films 10 formed thereto. The structure in detail and functions of the light-shielding film 10 will be described later.

And, as shown in FIG. 3, the electrode group (X electrode 14 and Y electrode 15) and the light-shielding film 10 formed to the front substrate structure 11 are covered with a dielectric layer 17. Further, on a surface of the dielectric layer 17, a protective layer 18 formed of a metal oxide such as MgO (magnesium oxide) is formed. The protective layer 18 is formed so as to cover one surface of the dielectric layer 17.

While MgO is generally used because high sputtering resistance and a high secondary electrode emission coefficient are required to the protective layer 18, the material is not limited to this. For example, a composite material where MgO is mixed with CaO (calcium oxide) may be used. By mixing CaO, the sputtering resistance of the protective layer 18 can be improved. Alternatively, a material such as SrO having a higher secondary electron emission coefficient than MgO may be used.

On the other hand, the rear substrate structure 12 shown in FIG. 3 comprises a rear substrate (substrate, second substrate) 19 mainly formed of glass. The plurality of address electrodes (third electrodes) 20 are formed on a surface (second surface)

19*a* of the rear substrate 19 opposing the front substrate structure 11. Each address electrode 20 are formed to extend along a column direction (second direction, longitudinal direction) DY crossing (substantially orthogonally crossing) the direction in which the X electrode 14 and the Y electrode 15 are extending. And, each address electrode 20 is arranged to have a predetermined arrangement spacing to be substantially parallel.

The address electrode 20 and the Y electrode 15 formed to the front substrate structure 11 configure an electrode pair for performing address discharge which is a discharge for selecting on/off of the cell 25. More particularly, the Y electrode 15 has a function of an electrode for sustain discharge and a function of an electrode for address discharge together.

The address electrode 20 is covered with a dielectric layer 21. A plurality of barrier ribs (first barrier rib, longitudinal rib) 22 extending in the thickness direction of the rear substrate structure 12 are formed on the dielectric layer 21. The barrier rib 22 is formed to extend in line along the column direction DY in which the address electrode is extending. And, a position of the barrier rib 22 on the plane is arranged between the address electrodes next to each other as shown in FIG. 4. By arranging the barrier rib 22 between the address electrodes 20 next to each other, the discharge gaps 24 sectioning the surface of the dielectric layer 21 in the column direction DY corresponding to the position of each address electrode 20 are formed.

And, phosphor portions 23*r*, 23*g*, 23*b* which emit visible light of respective colors of red (R), green (G), blue (B) when excited by vacuum ultraviolet rays are formed at respective predetermined positions on the upper surface of the dielectric layer 21 formed on the address electrode 20 and sidewalls of the barrier rib 22.

Further, the front substrate structure 11 and the rear substrate structure 12 shown in FIG. 3 are fixed in a state where the surface to which the protective layer 18 is formed and the surface to which the barrier rib 22 is formed are opposing each other. And, a peripheral portion of the PDP 1 not shown is sealed by, for example, a sealant called frit such as low-melting-point glass, and gas (e.g., mixed gas of Ne and Xe) called discharge gas not shown is filled in the discharge gap 24 at a predetermined pressure.

As shown in FIG. 4, one cell 25 is formed corresponding to the intersection of one pair of the X electrode 14 and the Y electrode 15 and the address electrode 20. The planar area of the cell 25 is defined by the spacing between the pair of the X electrode 14 and the Y electrode 15 and the arrangement spacing between the barrier ribs 22.

Also, any one of the red phosphor portion 23*r*, the green phosphor portion 23*g*, and the blue phosphor portion 23*b* shown in FIG. 3 is formed in each cell 25.

A pixel is formed by the set of respective cells 25 of R, G, B. More particularly, respective phosphor potions 23*r*, 23*g*, 23*b* are emission elements of the PDP 1 and exited by vacuum ultraviolet ray having a predetermined wavelength generated by sustain discharge, thereby emitting visible light of respective colors of red (R), green (G), and blue (B).

The PDP 1 has a configuration in which sustain discharge is generated per the cell 25 so that each phosphor portion 23 of R, G, B is excited by vacuum ultraviolet ray generated by the sustain discharge, thereby emitting light.

<Detailed Structure of Light-Shielding Film>

Next, detailed structure of the light-shielding film 10 shown in FIG. 3 and FIG. 4 will be described with reference to FIG. 3 to FIG. 5. Note that, a PDP 50 which is a comparative example to the first embodiment is shown in FIG. 12 and FIG. 13 as a comparative example of the PDP 1 of the first embodiment.

Figure 5:
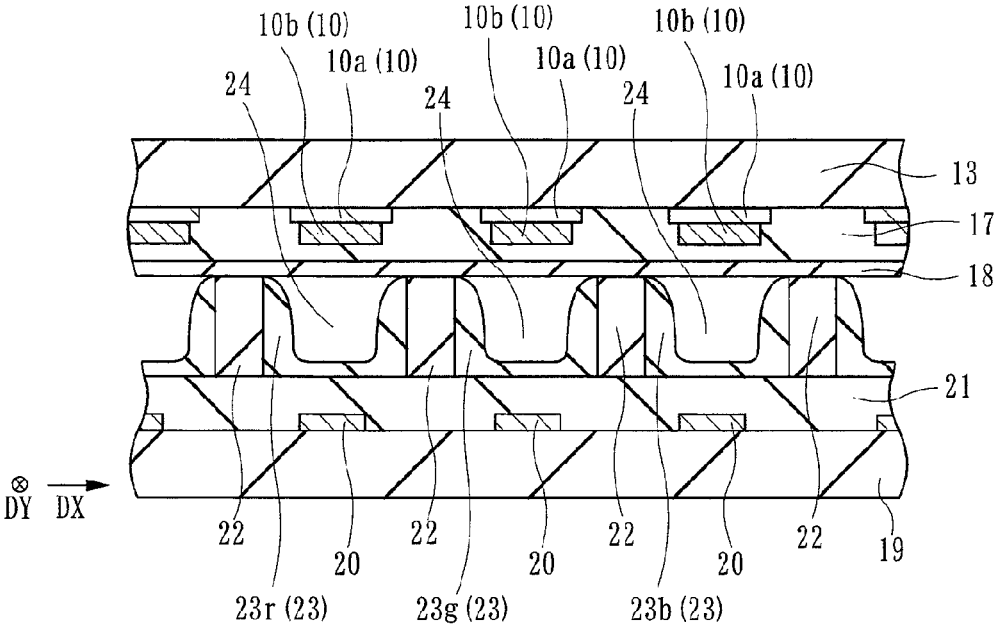
FIG. 5 is an enlarged cross-sectional view of main parts showing part of a cross section taken along the line A-A shown in FIG. 4 in an enlarged manner.

FIG. 5 is an enlarged cross-sectional view of main parts showing part of a cross section taken along the line A-A shown in FIG. 4 in an enlarged manner. And, FIG. 12 is an enlarged planar view of main parts showing a planar positional relationship of the electrode group, the barrier rib, and the light-shielding film of the PDP 50 which is a comparative example of the first embodiment viewed from the display surface, and FIG. 13 is an enlarged cross-sectional view of main parts showing part of a cross section taken along the line B-B shown in FIG. 12 in an enlarged manner.

Note that, in the PDP 50 shown in FIG. 12 and FIG. 13, members having same structures and functions as those of the first embodiment are denoted by same reference symbols, and repetitive descriptions will be omitted.

In FIG. 4, the light-shielding film 10 is formed of a material same as the X electrode 14 and the Y electrode 15 configuring the display electrode pair of the PDP 1 (cf. FIG. 3). More particularly, the light-shielding film 10 includes a transparent portion 10*a* formed of a material (e.g., ITO) same as the X transparent electrode 14*a* and the Y transparent electrode 15*a*, and a light-shielding portion 10*b* formed of a metal material (e.g., multilayered body of Cr/Cu/Cr) composed by a same metal material as that of the X bus electrode 14*b* and the Y bus electrode 15*b*.

In this manner, the light-shielding film 10 is formed of a conductive material, and thus the X electrode 14 and the Y electrode 15 are formed with spacing therebetween.

By forming the light-shielding film 10 by a same material as that of the X electrode 14 and the Y electrode 15 configuring the display electrode pair of the PDP 1 (cf. FIG. 3), the light-shielding film 10 can be formed with the X electrode 1 and the Y electrode 15 in the manufacturing process of the PDP 1 at one time, thereby reducing the manufacturing process.

However, like the light-shielding film 51 which the PDP 50 shown in FIG. 12 comprises, when the light-shielding film 51 formed of a conductive material is formed in a stripe-shape extending along the row direction DX, the area where the X bus electrode 14*b* or the Y bus electrode 15*b* and the light-shielding film 51 are extending along each other becomes larger.

Therefore, the X bus electrode 14*b* or the Y bus electrode 15*b* and the light-shielding film 1 get to be capacitance-coupled and function as a capacitor. In such a state, if a predetermined potential is supplied to the X bus electrode 14*b* or the Y bus electrode 15*b* in either of the initialization sequence (reset period) TR, the address sequence (address period) TA for selecting cells to be turned on, or the display sequence (sustain discharge period) TS described with reference to FIG. 2, a charging current will flow between the X bus electrode 14*b* or the Y bus electrode 15*b* and the light-shielding film 51. This charging current is not a current which contribute to emission.

In other words, the power consumed for charging is reactive power which does not contribute to image display of the PDP 50.

Further, when charges are formed on the light-shielding film 51 by the capacitance coupling, it may pose error discharge upon performing the address discharge and the sustain discharge described with reference to FIG. 2.

If capacitance coupling occurs, the capacitance of the capacitance-coupled portion can be considered as same as a capacitance of a capacitor such as a planar plate capacitor. The capacitance of the planar plate capacitor gets larger proportionally to the dielectric constant (permittivity) of the material existing between the two plates provided opposing each other. And, the capacitance is also proportional to the planar area of the opposing surfaces of the two plates (i.e., the smaller the planar area of the opposing surfaces is, the more the capacitance is). Further, the capacitance gets smaller as the distance between the two plates is made longer, i.e., the capacitance is inversely proportional to the distance between the two plates.

Accordingly, in the first embodiment, as shown in FIG. 5, the light-shielding film 10 is formed in an island-shape, so that a structure where the light-shielding film 10 is isolated per the cell 25 is obtained (cf. FIG. 4). By forming the light-shielding film 10 in island-shape, the area of the opposing surface of the light-shielding film 10 arranged substantially parallel to the X bus electrode 14*b* or the Y bus electrode 15*b* can be made small.

Therefore, the capacitance coupling between the X bus electrode 14*b* or the Y bus electrode 15*b* and the light-shielding film 51 which may pose reactive power and error discharge can be suppressed.

Further, the transparent portion 10*a* and the light-shielding portion 10*b* are subsequently layered from a surface 13*a* side of the front substrate 13 as shown in FIG. 3. When the light-shielding portion 10*b* having a tone of black or dark color is directly formed on the surface of the front substrate 13 which is a substrate of display surface side, the area where the light-shielding portion 10*b* is formed becomes like a mirror surface.

The area where the light-shielding portion 10*b* is formed and becomes a mirror surface has more reflection (specular reflection) of outside light irradiating orthogonally to the area. Therefore, in the PDP device embedding the PDP 1, a phenomenon that the figure of the watcher himself is reflected (glared) on the display surface occurs.

Accordingly, in the first embodiment, the transparent portion 10*a* and the light-shielding portion 10*b* are sequentially layered from the surface 13*a* side of the front substrate 13, so that the transparent portion 10*a* is interposed between the light-shielding portion 10*b* and the front substrate 13.

In this manner, the area where the light-shielding portion 10*b* is formed can be prevented from becoming like a mirror surface. Specifically, above-mentioned phenomenon of figure reflection can be suppressed.

Further, the light-shielding film 10 is formed having spacing from the barrier rib 22 next to each other. In other words, the light-shielding film 10 is not formed at a position overlapping the barrier rib 22 as shown in FIG. 4 and FIG. 5.

Here, in the case of the PDP 50 shown in FIG. 13 which is a comparative example of the first embodiment, the light-shielding film 51 formed of a same material as that of the X electrode 14 and the Y electrode 15 is formed at a position overlapping the barrier rib 22. In the case where the light-shielding film 51 is formed at a position overlapping the barrier rib 22, as shown as a capacitor (capacitance-coupling portion) CA in FIG. 13, a capacitance coupling may occur between the light-shielding film 51 and the address electrode 20.

This is because the light-shielding film 51 and the address electrode 20 are (substantially linearly) connected interposing the dielectric layer 17, the protective layer 18, the barrier rib 22, the phosphor portion 23, and the conductive layer 21 etc. having a higher dielectric constant than that of the discharge gas filled in the discharge gap 24 in the area where the barrier rib 22 is formed.

When the light-shielding film 51 and the address electrode 20 are connected (substantially linearly) by a member having a high dielectric constant, the apparent capacitance of the capacitor CA becomes significantly large. More particularly, when a pulse is applied to the address electrode 20 shown in FIG. 13 for supplying a predetermined potential in the address sequence (address period) TA described with reference to FIG. 2, a charging current which does not contribute to the emission flows between the light-shielding film 51 and the address electrode 20, so that the reactive power of the PDP 50 is increased.

Further, as shown in FIG. 13, the capacitor CA is formed across the barrier rib 22. Therefore, for example, when supplying a pulse for supplying a predetermined potential to the address electrode 20*a* to which the capacitor CA is formed, charges may be formed on an area 52 where the capacitor CA is overlapping the adjacent discharge gap 24*a* due to the capacitance coupling shown by the capacitor CA.

If charges are formed like this on the area 52 where the capacitor CA is overlapping the discharge gap 24*a* next to the line in which the address electrode 20*a* is arranged, it poses error discharge upon performing address discharge operation and sustain discharge operation at the cell 25 arranged at the discharge gap 24*a* (cf. FIG. 12).

To prevent this error discharge, it is necessary to suppress the pulse voltage to be applied across the address electrode 20*a* and the Y electrode 15 (cf. FIG. 12) low, but if the applied pulse voltage is too low, the predetermined address discharge cannot be generated. Therefore, a margin (allowable range, operating margin) of the pulse voltage to be applied for performing the predetermined address discharge operation as well as preventing error discharge due to the capacitance coupling between the light-shielding film 51 and the address electrode 20 is reduced. Therefore, control of the address sequence (address period) TA described with reference to FIG. 2 becomes difficult.

Accordingly, in the first embodiment, the light-shielding film 10 is formed in an island-shape with spacing from the neighboring barrier rib 22 as shown in FIG. 5 so that the light-shielding film 10 is not formed to a position overlapping the barrier rib 22.

By making the structure in this manner, in the PDP 1 (cf. FIG. 4), it is possible to prevent the light-shielding film 10 and the address electrode 20 from (substantially linearly) connecting to each other interposing the dielectric layer 17, the protective layer 18, the barrier rib 22, the phosphor portion 23, and the conductive layer 21 etc. having a higher dielectric constant than that of the discharge gas filled in the discharge gap 24.

Note that, there is occurred a part where the light-shielding film 10 and the address electrode 20 are connected via the discharge gas filled in the discharge gap 24. However, the dielectric constant of the discharge gas is much lower than that of the dielectric layer 17, the protective layer 18, the barrier rib 22, the phosphor portion 23, and the conductive layer 21, and thus even a capacitance coupling occurs, the capacitance thereof is negligibly small.

Meanwhile, the PDP 1 does not have the light-shielding portion 10*a* of the light-shielding film 10 formed in the area where the barrier rib 22 is formed. Therefore, the reflectivity of outside light in the area where the barrier rib 22 is formed is relatively higher than the PDP 50 shown in FIG. 12.

However, in the area where the barrier rib 22 is formed, the phosphor portion 23 (it has a high reflectivity because it generally has white tone) shown in FIG. 3 are not formed. Therefore, the reflectivity of the area where the barrier rib 22 is formed has a half the reflectivity of the area where the phosphor portion 23 is formed, thereby suppressing the reduction of bright-room contrast.

As described in the foregoing, according to the first embodiment, by forming the light-shielding film 10 in island-shape, the opposing planar area of the light-shielding film 10 arranged substantially parallel to the X bus electrode 14*b* or the Y bus electrode 15*b* can be made small, thereby suppressing capacitance coupling between the X bus electrode 14*b* or the Y bus electrode 15*b* and the light-shielding film 10 which poses reactive power and error discharge.

Further, by forming the light-shielding film 10 in island-shape with spacing from the neighboring barrier rib 22, formation of capacitance coupling across the barrier rib 22 which poses reactive power and error discharge can be prevented.

<Method of Manufacturing PDP>

Next, a summary of a method of manufacturing the PDP 1 of the first embodiment will be described with reference to FIG. 3 and FIG. 4. The method of manufacturing the PDP 1 comprises the following steps.

(a) At the start, the front substrate structure 11 shown in FIG. 3 is formed. The front substrate structure is formed by, for example, the following steps.

First, the front substrate (first substrate) 13 is prepared and the X electrode 14, the Y electrode 15, and the light-shielding film 10 are formed on the surface 13*a* which is opposite to the display surface. The formation of the X electrode 14, the Y electrode 15, and the light-shielding film 10 can be performed by, for example, photolithography and etching.

First, a transparent material film which is a material of the X transparent electrode (transparent electrode portion) 14*a*, the Y transparent electrode (transparent electrode portion) 15*a*, and the transparent portion 10*a* of the light-shielding film 10, for example, ITO and the like is formed on the surface 13*a* of the front substrate 13 by, for example, printing.

Next, after a resist film is applied on the surface of the transparent material film, the surface thereof is covered with a mask having a pattern like shown in FIG. 4, and exposure and development are performed to form a resist film having a desired pattern. Subsequently, after removing the areas which have not been covered with the resist film by etching, the resist film is stripped, thereby obtaining the X transparent electrode 14*a*, the Y transparent electrode 15*a*, and the transparent portion 10*a* having a desired pattern like shown in FIG. 4.

Next, the X bus electrode (light-shielding electrode portion) 14*b*, the Y bus electrode (light-shielding electrode portion) 15*b* are stacked (layered) on the X transparent electrode 14*a* and the Y transparent electrode 15*a*, respectively The X bus electrode 14*b*, the Y bus electrode 15*b*, and the light-shielding portion 10*b* of the light-shielding film 10 are also formed by photolithography and etching similarly.

First, a metal material film which is a material of the X bus electrode 14*b*, the Y bus electrode 15*b*, and the light-shielding portion 10*b* of the light-shielding film 10 is formed on the surface 13*a* of the front substrate 13 on which the X transparent electrode 14*a*, the Y transparent electrode 15*a*, and the transparent portion 10*a* of the light-shielding film 10 are formed.

In the step of forming the metal material film, for example, a resin paste in which metal particles of, for example, Ag are diffused, which is called conductive paste is applied and then fired, thereby obtaining the metal material film. And, for example, when forming a metal material film having a multilayered structure of Cr/Cu/Cr, it can be formed by evaporation.

Next, after a resist film is applied on the surface, the surface of covered with a mask having a pattern like shown in FIG. 4, and exposure and development are performed to form a resist film having a desired pattern. Subsequently, after removing the areas which have not been covered with the resist film by etching, the resist film is stripped, thereby obtaining the X bus electrode 14*b*, the Y bus electrode 15*b*, and the light-shielding portion 10*b* having a desired pattern like shown in FIG. 4.

Here, when using photolithography and etching, with regards to processing accuracy, the respective areas of the transparent electrodes 14*a*, 15*a* and the transparent portion 10*a* are made larger than those of the respective bus electrodes 14*b*, 15*b* and the light-shielding portion 10*b*. This is for interposing the respective transparent electrode 14*a*, 15*a* and the transparent portion 10*a* between the front substrate and the bus electrodes 14*b*, 15*b* and the light-shielding portion 10*b*, respectively.

In the first embodiment, the light-shielding film 10 is formed of a same material with the X electrode 14 and the Y electrode 15. Therefore, the X electrode 14, Y electrode 15 and the light-shielding film 10 can be formed at once as described above, thereby shortening the manufacturing process.

After forming the X electrode 14, Y electrode 15 and the light-shielding film 10 on the surface 13*a* of the front substrate 13, the dielectric layer 17 and the protective layer 18 for covering the X electrode 14, Y electrode 15 and the light-shielding film 10 are sequentially layered on the front substrate 13.

(b) Further, the rear substrate structure 12 shown in FIG. 1 is formed. The rear substrate structure 12 is formed by, for example, the following process.

First, the rear substrate 19 is prepared and the address electrode 20 is formed on one surface (second surface) of the rear substrate 19 in a predetermined pattern. Secondly, the dielectric layer 21 is formed on the surface of the rear substrate 19 so as to cover the address electrode 20. Thirdly, the barrier rib 22 which sections the discharge gap 24 is formed on the surface of the dielectric layer 21. The barrier rib 22 is formed to extend along the address electrode 20. Then, the phosphor portions 23 are applied inside the respective discharge gaps 24 sectioned by the barrier ribs 22 and heated, thereby forming the rear substrate structure 12.

Note that, the rear substrate structure 12 is not necessarily prepared at this stage, and it is only necessary to be prepared before the step (c) described below.

(c) Next, the substrate structures are assembled by aligning the structures with opposing the first surface side of the front substrate structure 11 and the second surface side of the rear substrate structure 12.

In this step, the position of the electrode group (X electrode 14, Y electrode 15, address electrode 20) formed to either of the substrate structures 11, 12 is aligned so as to have a predetermined positional relationship like shown in FIG. 2, and then fixed as aligned, and the periphery of each substrate structure 11, 12 is sealed by a sealant (e.g., seal frit).

After the periphery of the substrate structures 11, 12 are sealed, the gas inside the discharge gap 24 is exhausted through an air hole not shown formed in any one of the substrate structures 11, 12. And, a predetermined discharge gas is filled through the air hole at a predetermined pressure. After the discharge gas is filled, the air hole is sealed, thereby obtaining the PDP 1 shown in FIG. 3.

Second Embodiment

In the first embodiment described above, it has been described an example where a material forming the X electrode 14 and the Y electrode 15 and a material forming the light-shielding film 10 are the same. Meanwhile, to obtain the effect of improving bright-room contrast by reducing reflectivity of outside light by forming the light-shielding film 10, the light-shielding portion 10*b* is only necessary to be formed.

In the following, a PDP according to a second embodiment will be described with reference to FIG. 6 and FIG. 7. Note that, in a PDP 30 to be described in the second embodiment, components having same structure and function as those of the PDP 1 in the first embodiment will be denoted by same reference symbols, and repetitive descriptions thereof will be omitted.

Figure 6:
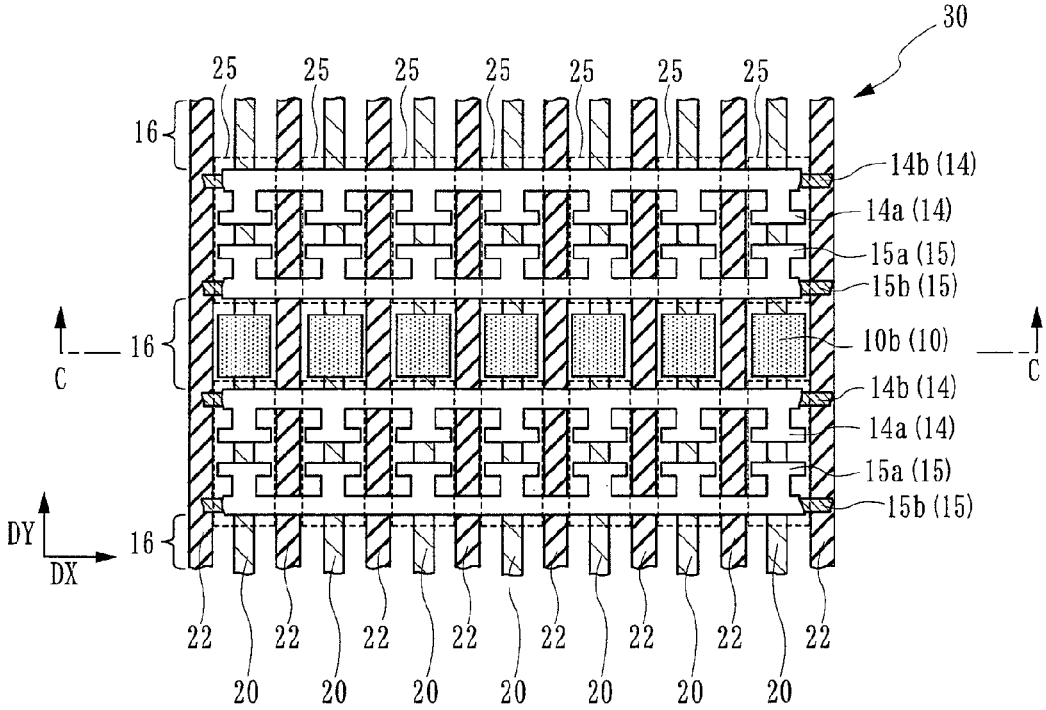
FIG. 6 is an enlarged planar view of main parts showing a planar positional relationship of an electrode group, a barrier rib, and a light-shielding film of a PDP according to a second embodiment of the present invention viewed from a display surface side.

FIG. 6 is an enlarged planar view of main parts showing a positional relationship of an electrode group, barrier rib, and light-shielding film of the PDP which is a first modification example of the first embodiment viewed from a display surface side. FIG. 7 is an enlarged cross-sectional view of main parts showing part of a cross section taken along the line C-C shown in FIG. 6 in an enlarged manner.

Different point of the PDP 30 of the second embodiment shown in FIG. 6 from the PDP 1 shown in FIG. 4 is that the light-shielding film 10 of the PDP 30 is formed by only the light-shielding portion 10*b*.

A component material of the light-shielding film 10 is not necessarily being same with the X electrode 14 and the Y electrode 15. In other words, as shown in FIG. 6 and FIG. 7, it is only necessary that a metal material common with the metal material having light-shielding property (e.g., Ag, Cu, Cr) among the component materials of the X electrode 14 and the Y electrode 15 is contained.

By forming the light-shielding film 10 using a metal material common with the metal material having light-shielding property among the component materials of the X electrode 14 and the Y electrode 15, the light-shielding film 10 can be formed at the same time with the X electrode 14 and the Y electrode 15 as with the first embodiment.

Figure 7:
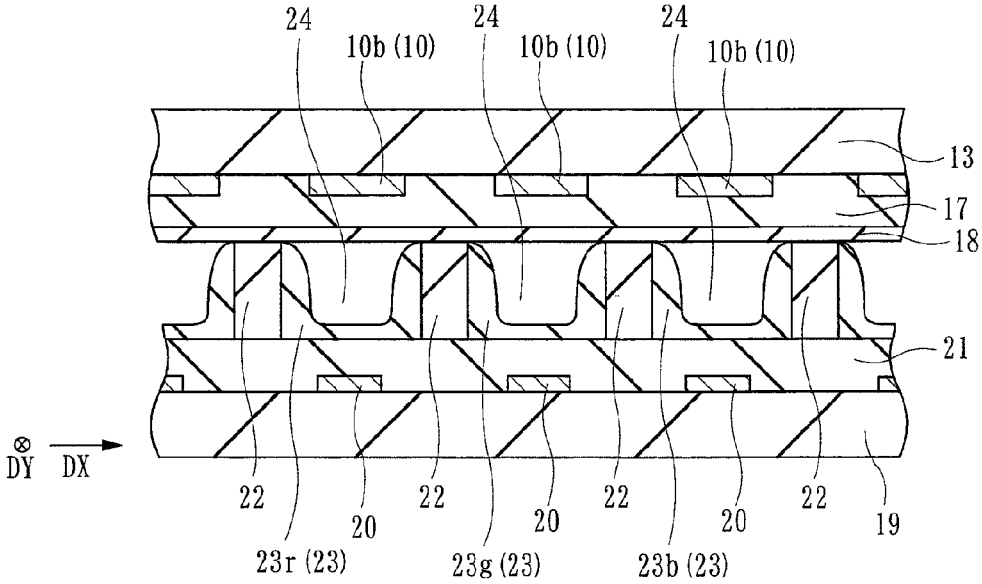
FIG. 7 is an enlarged cross-sectional view of main parts showing part of a cross section taken along the line C-C shown in FIG. 6 in an enlarged manner.

By forming the light-shielding film 10 only by a metal material having light-shielding property among the component materials of the X electrode 14 and the Y electrode 15 (i.e., forming the light-shielding film 10 only by the light-shielding portion 10*b*), the area of the light-shielding portion 10*b* in the non-emission area 16 can be made larger as shown in FIG. 6 and FIG. 7. This is because, since it is unnecessary to form the light-shielding portion 10*b* on the transparent portion 10*a* (cf. FIG. 4) in the step of forming the light-shielding portion 10*b* described above, even taking processing accuracy of photolithography and etching into account, the light-shielding portion 10*b* can be made wider until a size as the transparent portion 10*a* (i.e., a maximum size in a range where the light-shielding portion 10*b* does not overlap the X electrode 14, Y electrode 15, and the barrier rib 22) shown in FIG. 4.

In this manner, according to the second embodiment, the PDP 30 can widen the area of the light-shielding portion 10*b* of the light-shielding film 10 as compared with the PDP 1 described in the first embodiment above, thereby absorbing outside light irradiated on the non-emission area 16 more efficiently. Therefore, the bright-room contrast can be further improved.

Third Embodiment

Next, a PDP according to a third embodiment will be described with reference to FIG. 8 and FIG. 9. Note that, in a PDP 35 to be described in the third embodiment, components having same structure and function as those of the PDP 1 in the first embodiment will be denoted by same reference symbols, and repetitive descriptions thereof will be omitted.

Figure 8:
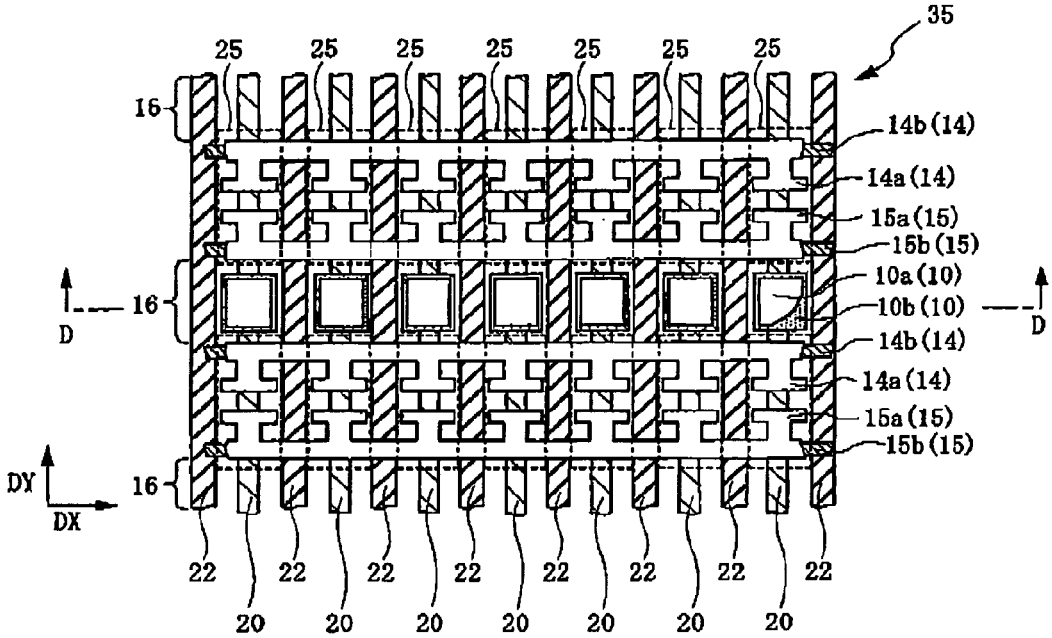
FIG. 8 is an enlarged planar view of main parts showing a planar positional relationship of an electrode group, a barrier rib, and a light-shielding film of a PDP according to a third embodiment of the present invention viewed from a display surface side.

FIG. 8 is an enlarged planar view of main parts showing a planer positional relationship of an electrode group, a barrier rib, and a light-shielding film of the PDP 35 according to the third embodiment viewed from a display surface side. FIG. 9 is an enlarged cross-sectional view of main parts showing a cross section taken along the line D-D shown in FIG. 8 in an enlarged manner.

Different point of the PDP 35 of the third embodiment from the PDP 1 shown in FIG. 4 is that the transparent portion 10*a* of the light-shielding film 10 has a smaller area than the light-shielding portion 10*b* in the PDP 35 shown in FIG. 8.

The transparent portion 10*a* of the light-shielding film 10 has a function of suppressing the mirror-like reflection (glare) by preventing increase of the specular reflection of outside light. Since the PDP 30 described in the second embodiment does not have the transparent portion 10*a* (cf. FIG. 8), there is a higher possibility to have the phenomenon of mirror-like reflection as compared with the PDP 1 of the first embodiment.

Accordingly, the PDP 35 shown in FIG. 8 has a structure where the light-shielding film 10 has the transparent portion 10*a*. By forming the transparent portion 10*a*, the mirror-like reflection (glare) can be suppressed.

Figure 9:
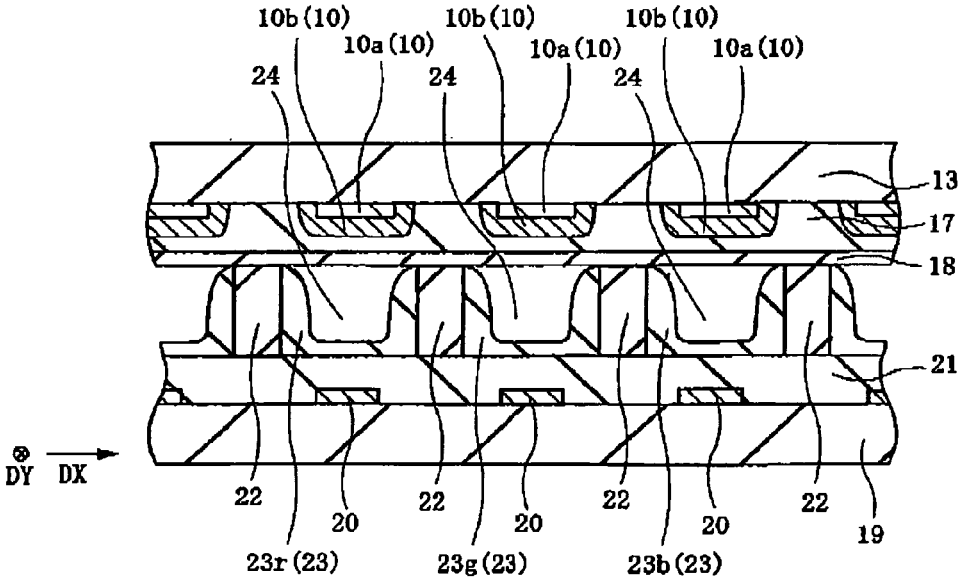
FIG. 9 is an enlarged cross-sectional view of main parts showing part of a cross section taken along the line D-D shown in FIG. 8 in an enlarged manner.

Note that, since the outer circumference portion of the light-shielding portion 10*b* is directly formed on the front substrate 13 in the PDP 35 as shown in FIG. 9, the possibility of the mirror-like reflection to occur is slightly high as compared with the PDP 1 described in the first embodiment.

However, the part directly formed to the front substrate is only the outer circumference portion, and thus the area where the light-shielding portion 10*b* contacts the front substrate 12 is smaller than the area where the transparent portion 10*a* contacts the front substrate 13. Therefore, the degree of the mirror-like reflection is very low in the PDP 35 as compared with the PDP 30 described in the second embodiment.

In addition, as shown in FIG. 8 and FIG. 9, the area of the transparent portion 10*a* of the light-shielding film 10 is formed to be smaller than that of the light-shielding portion 10*b* in the PDP 35. By making the area of the transparent portion 10*a* smaller than that of the light-shielding portion 10*b*, the area of the light-shielding portion 10*b* in the non-emission area 16 can be made larger even taking the processing accuracy of photolithography and etching into account.

In this manner, according to the third embodiment, by making the area of the transparent portion 10*a* smaller than that of the light-shielding portion 10*b*, it is possible to widen the area of the light-shielding portion 10*b* as well as suppressing the mirror-like reflection, thereby absorbing outside light irradiated on the non-emission area 16 more efficiently.

Fourth Embodiment

Next, a PDP according to a fourth embodiment will be described with reference to FIG. 10 and FIG. 11. Note that, in a PDP 40 to be described in the second embodiment, components having same structure and function as those of the PDP 1 in the first embodiment will be denoted by same reference symbols, and repetitive descriptions thereof will be omitted.

FIG. 10 is an enlarged planar view of main parts showing a positional relationship of an electrode group, barrier rib, and light-shielding film of a PDP which is a modification example of the fourth embodiment viewed from a display surface side. FIG. 11 is an enlarged planar view of main parts showing the area E shown in FIG. 10 in further enlarged manner.

Different point of the PDP 40 according to the fourth embodiment shown in FIG. 10 from the PDP 1 shown in FIG. 4 is that a light-shielding film 41 which the PDP 40 has shown in FIG. 10 is formed in a stripe-shape. Note that, a different point of the light-shielding film 41 and the light-shielding film 10 shown in FIG. 3 and FIG. 4 is only the shapes, and other points (material, method of manufacturing, and the fact a transparent portion 41*a* and a light-shielding portion 41*b* are comprised, etc.) are same as the light-shielding film 10 described in the first embodiment. Therefore, repetitive descriptions thereof will be omitted.

As shown in FIG. 10, by forming the light-shielding film 41 in stripe-shape, the manufacturing efficiency can be improved in the process of forming the light-shielding film 41. A reason thereof will be described below.

As described in the first embodiment above, the light-shielding film 41 is formed by using photolithography and etching. Here, as described in the first embodiment, to form the transparent portion 41*a* and the light-shielding portion 41*b* of the light-shielding film 41 in a desired pattern, a step of placing a mask formed in the desired pattern before exposure and a step of removing a resist film after etching are required.

Here, in the case of the PDP 1 described in the first embodiment, since the light-shielding film 10 is isolated in the island-shape, the step of placing a mask or the step of stripping the resist film is required to be performed separately per the light-shielding film 10.

On the other hand, since the light-shielding film 41 of the PDP 40 of the fourth embodiment is continuous in the stripe-shape, the light-shielding film 41 can be processed in the step of placing the mask or the step of stripping the resist film at one time.

Therefore, according to the fourth embodiment, the manufacturing efficiency can be improved in the step of forming the light-shielding film 41.

Meanwhile, to form the light-shielding film in a stripe-shape, it is necessary to effectively suppress capacitance coupling between the X bus electrode 14*b*, the Y bus electrode 15*b* or the address electrode and the light-shielding film 41 as described in the first embodiment.

Accordingly, as shown in FIG. 11, in the PDP 40 of the fourth embodiment, a width L42 of the light-shielding film 41 in an area (first area) 42 where the light-shielding film 41 overlaps the barrier rib 22 is formed to be as narrower as possible than a width L43 of the light-shielding film 41 in an area (second area) 43 where the light-shielding film 41 does not overlap the barrier film 22. Note that, while the widths L42, L43 are shown as widths of the light-shielding portion 43*b* in FIG. 11, it is same to the width of the transparent portion 41*a*.

The width L42 of the light-shielding film 41 in the area 42 where the light-shielding film 41 overlaps the barrier rib 22 is only necessary to have a width which will not allow the mask and the resist film to be cut in the step of placing the mask or the step of stripping the resist film, and it is preferred to be as narrow as possible.

As described in the first embodiment above, in the case where capacitance coupling is formed between the light-shielding film 41*b* and the address electrode 20, when the capacitance-coupled portion is formed across the barrier rib 22, the capacitance becomes significantly large.

However, in the fourth embodiment, by narrowing the width L42 of the light-shielding film 41 in the area 42 where the light-shielding film 41 overlaps the barrier rib 22, the area of the light-shielding film of the capacitance-coupled portion formed across the barrier rib 22 can be suppressed to minimum.

Therefore, as compared with the PDP 50 shown in FIG. 12 and FIG. 13 described in the first embodiment as a comparative example, it is possible to suppress capacitance coupling which poses increase of reactive power and reduction of operating margin.

Note that, the structure of the second embodiment or the third embodiment can be used to the PDP 40 shown in FIG. 10 described in the fourth embodiment. More particularly, the light-shielding film 41 shown in FIG. 10 can be formed by only the light-shielding portion 41*b*. And, the area of the transparent portion 41*a* of the light-shielding film 41 can be formed to be smaller than that of the light-shielding portion 41*b*.

It is needless to say that the effects described in the second embodiment and the third embodiment can be obtained in this case.

In the foregoing, the invention made by the inventors of the present invention has been concretely described based on the embodiments. However, it is needless to say that the present invention is not limited to the foregoing embodiments and various modifications and alterations can be made within the scope of the present invention.

For example, there are various structures of PDP exist corresponding to required property and drive method, and the present invention is applicable to different PDP structures than the PDPs 1, 30, 35, 40 described in the first to fourth embodiments.

For example, as an example of a structure of PDP, the structure called stripe rib where the discharge gap 24 is sectioned by barrier ribs (first barrier rib, longitudinal rib) 22 extending in line (longitudinal direction) has been described in the first embodiment.

Meanwhile, as aiming to improve luminance and so on, there also is a structure called box rib where a plurality of lateral barrier ribs (second barrier rib, lateral rib) substantially orthogonally crossing the barrier rib 22 are formed, and the every cell 25 is sectioned by the barrier rib 22 and the lateral barrier rib.

When applying the present invention to the box-rib structure in this manner, for example, capacitance coupling can be suppressed by forming the light-shielding film 10 described in the first embodiment in an island-shape with spacing from the neighboring first barrier rib and the neighboring second barrier rib.

Moreover, as described in the fourth embodiment, when forming the light-shielding film 41 in a stripe-shape, since it is unnecessary to form the light-shielding film 41 in the area where the light-shielding film 41 overlaps the barrier rib 22, the width of the light-shielding film 41 in the area where the light-shielding film 41 overlaps the first barrier rib is formed to be narrower than the width of the light-shielding film 41 in the area where the light-shielding film 41 does not overlap the first barrier rib, thereby suppressing capacitance coupling.

What is claimed is:

1. A plasma display panel comprising a first substrate structure and a second substrate structure which oppose each other interposing a discharge gap, wherein the first substrate structure includes:

a first substrate;

a plurality of display electrode pairs formed along a first direction at a first surface side of the first substrate opposing the second substrate structure;

cells sequentially formed along the first direction between the display electrode pair and selected to be turned on or off;

a dielectric layer covering the plurality of display electrode pairs;

a non-emission area formed to extend in the first direction between the two display electrode pairs next to each other; and a plurality of light-shielding films formed with spacing from the display electrode pair in the non-emission area not to contact the display electrode pair, the display electrode pairs forming the cells and the non-emission area are alternately formed in a direction crossing the first direction, the second substrate structure includes:

a second substrate;

an address electrode formed along a second direction crossing the first direction at a second surface side of the second substrate opposing the first substrate structure; and a barrier rib formed along the second direction at the second surface side of the second substrate so as to section the discharge space, the first substrate is formed of glass, the display electrode pair includes a transparent electrode portion and a light-shielding electrode portion having different light-shielding properties to visible light, the light-shielding electrode portion is formed of a metal material, and the plurality of light-shielding films are provided in every space between neighboring two lines of the display lines, formed in an island shape at a position not overlapping the barrier rib when viewed from a perpendicular direction to a plane portion of the first substrate, and formed by layering a transparent portion formed of a same material as that of the transparent electrode portion and a light-shielding portion formed of a same material as that of the light-shielding electrode portion sequentially from the first surface side of the first substrate, the transparent portion being interposed between the light-shielding portion and the first substrate.

2. The plasma display panel according to claim 1, wherein an area of the transparent portion of the light-shielding film is smaller than that of the light-shielding portion of the light-shielding film.

3. A method of manufacturing a plasma display panel comprising the steps of:

(a) forming a plurality of display electrode pairs, which sequentially form cells selected to be turned on or off along the first direction, and a plurality of light-shielding films extending in the first direction on a first surface of a first substrate at one time, and then forming a dielectric layer covering the display electrode pairs, thereby forming a first substrate structure;

(b) forming an address electrode along a second direction crossing the first direction on a second surface of a second substrate, and then forming a barrier rib for sectioning the second surface side into a plurality of discharge gaps, thereby forming a second substrate structure having phosphor portions formed in the discharge gaps sectioned by the barrier rib; and (c) aligning the first substrate structure and the second substrate structure as having the first surface side of the first substrate structure and the second surface side of the second substrate structure opposed each other, and wherein:

the plurality of light-shielding films are provided between the display lines formed from the display electrode pairs, and are formed in an island shape between the barrier ribs neighboring each other in a non-emission area extending in the first direction between the two display electrode pairs next to each other forming the cell with spacing from the display electrode pair not to contact the display electrode pair, the light-shielding film is formed at a position not overlapping the barrier rib when viewed from a perpendicular direction to a plane of the first substrate, and the light-shielding film is formed of a same material as that of a transparent electrode portion and a light-shielding portion forming the display electrode pair, the transparent electrode portion and the light-shielding portion being sequentially layered in this order from the first surface side of the first substrate formed of glass, and the transparent portion being interposed between the light-shielding portion and the first substrate.

* * * * *